US005142789A

United States Patent [19]

Shimizu

[11] Patent Number: 5,142,789

[45] Date of Patent: Sep. 1, 1992

[54] HEAD OF UNIVERSAL PARALLEL RULER

[75] Inventor: Kazutoshi Shimizu, Tokyo, Japan

[73] Assignee: Mutoh Industries Ltd., Tokyo, Japan

[21] Appl. No.: 723,276

[22] Filed: Jun. 28, 1991

[30] Foreign Application Priority Data

Jul. 27, 1990 [JP] Japan ..... 2-200328

[51] Int. Cl.[5] ..... B43L 13/08

[52] U.S. Cl. ..... 33/438; 33/440

[58] Field of Search ..... 33/430, 438, 439, 440, 33/441, 442, 465, 471

[56] References Cited

U.S. PATENT DOCUMENTS 4,578,872 4/1986 Yoshida et al. ..... 33/438

4,587,742 5/1986 Yoshida ..... 33/438

FOREIGN PATENT DOCUMENTS 82515 7/1956 Netherlands ..... 33/438

689864 10/1979 U.S.S.R. ..... 33/438

*Primary Examiner*—Harry N. Haroian

*Attorney, Agent, or Firm*—Wenderoth, Lind & Ponack

[57] ABSTRACT

A head of a universal parallel ruler having a base 2 supported so as to be movable in parallel on a drafting board comprises a scale mounting plate 16 having an upper portion supported so as to be rotatable on the upper face side of the base 2 and a handle member 34 provided above the scale mounting plate 16, so that an operator can hold the handle member 34 by hand to directly rotate the scale mounting plate 16 for carrying out a plotting operation.

6 Claims, 5 Drawing Sheets

HEAD OF UNIVERSAL PARALLEL RULER

BACKGROUND OF THE INVENTION

The present invention relates to a head of a universal parallel ruler.

The head of a universal parallel ruler has conventionally comprised a base, a protractor provided below the base, a scale mounting plate provided below the protractor, a main shaft supported by the base, and an operating handle disposed on the upper face side of the base to which the scale mounting plate is connected through the main shaft.

With the head of the universal parallel ruler having the above-mentioned structure, an operator has held the operating handle and rotated the scale mounting plate spaced from the lower side of the base, and therefore, he has not possessed such a sensation that he is directly rotating and operating the scale mounting plate. Thus, there is a defect that the operator feels restless in a plotting operation.

DESCRIPTION OF THE PREFERRED EMBODIMENT

Figure 1:
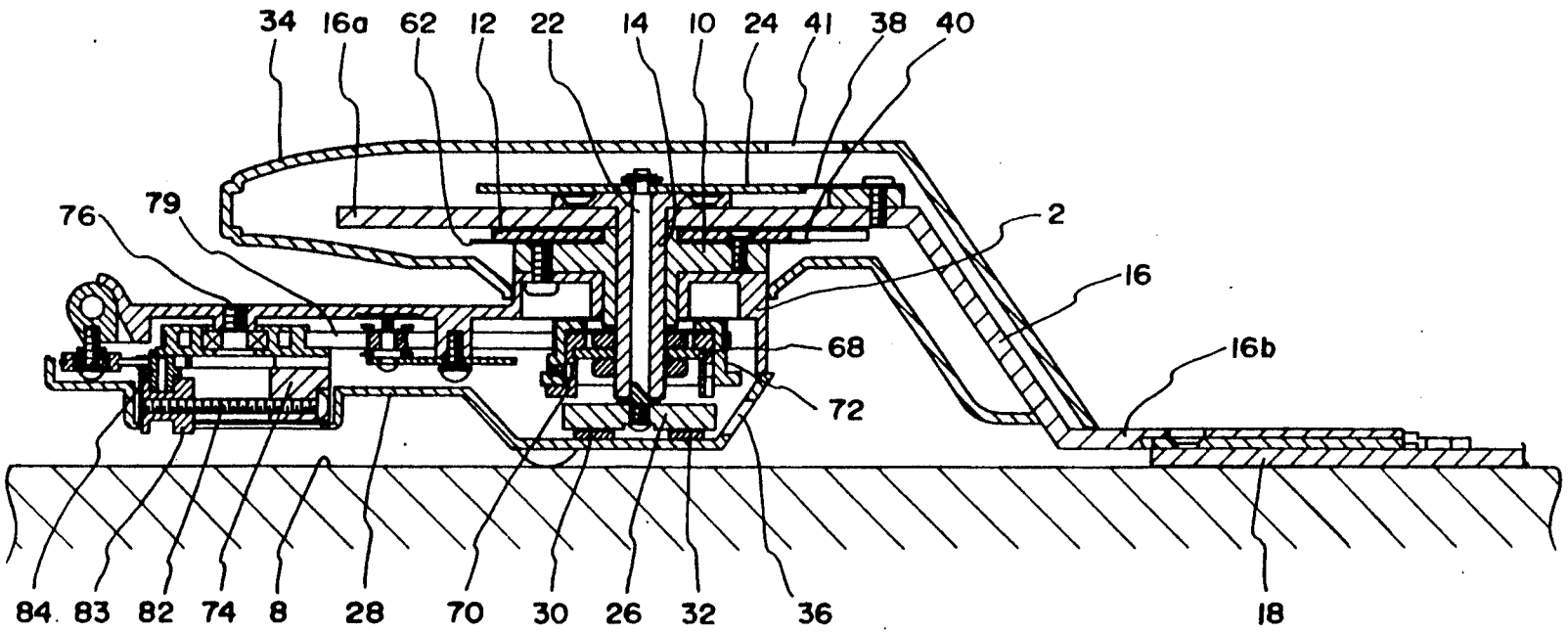
FIG. 1 is a sectional view of a head of a universal parallel ruler of the present invention.
Figure 2:
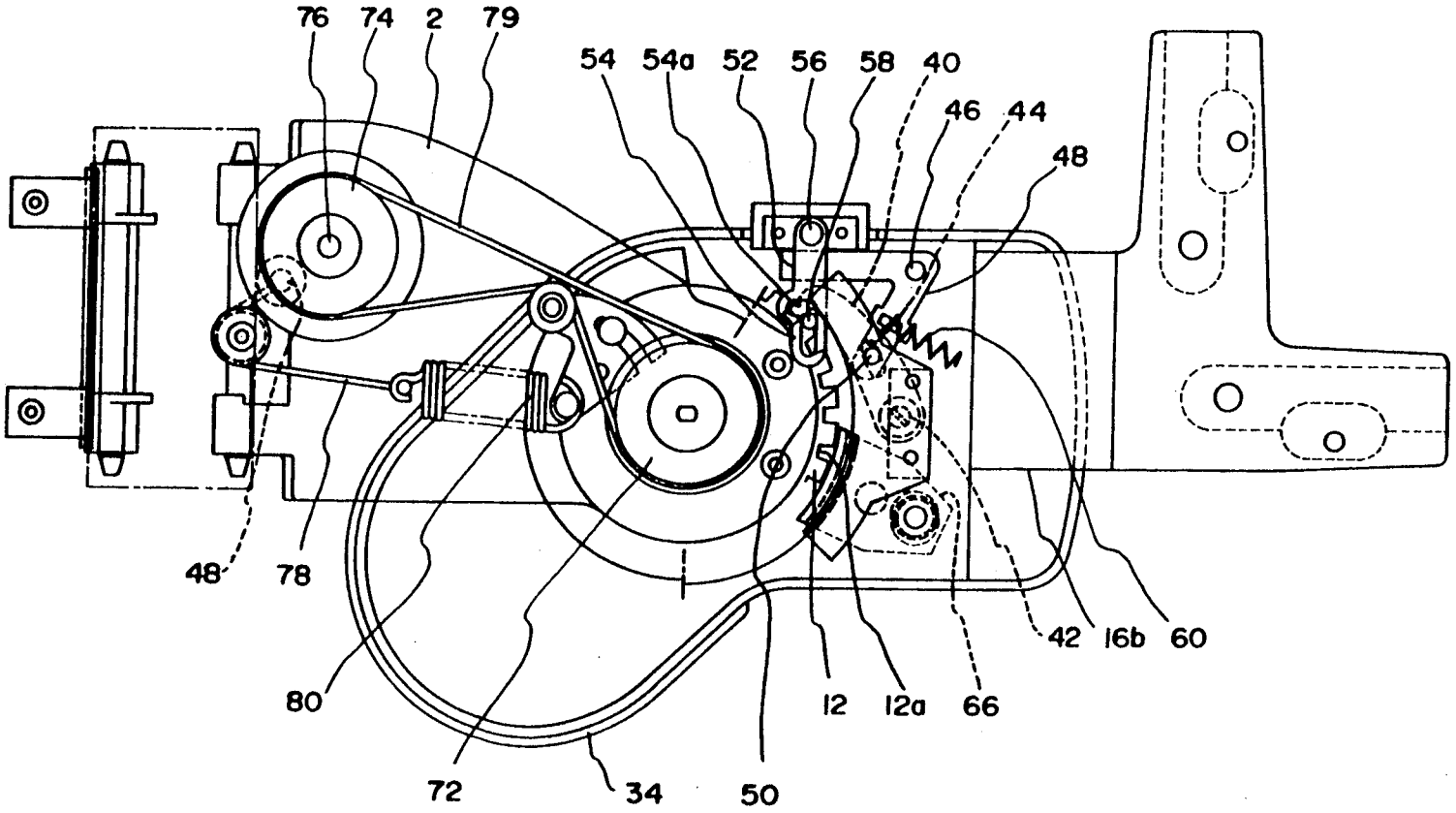
FIG. 2 is a plan view of the head of the universal parallel ruler of the present invention.
Figure 3:
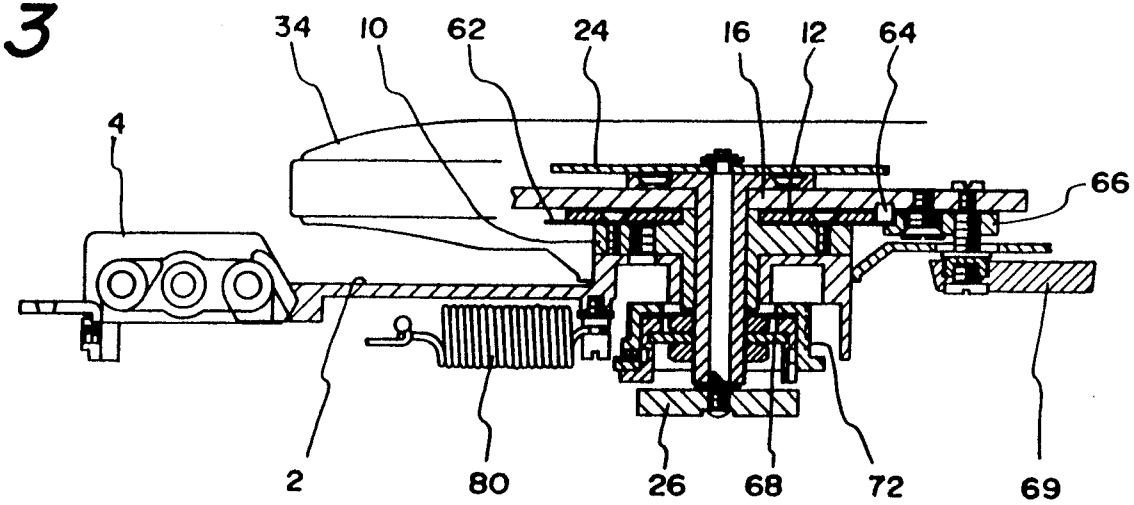
FIG. 3 is a sectional view of the head of universal parallel ruler of the present invention.
Figure 4:
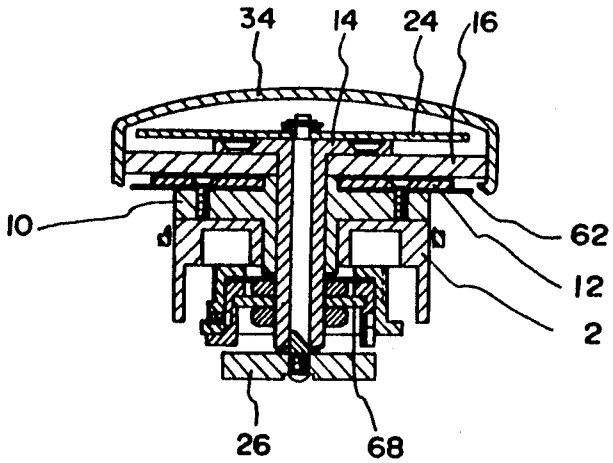
FIG. 4 is a sectional view of the head of universal parallel ruler of the present invention.
Figure 6:
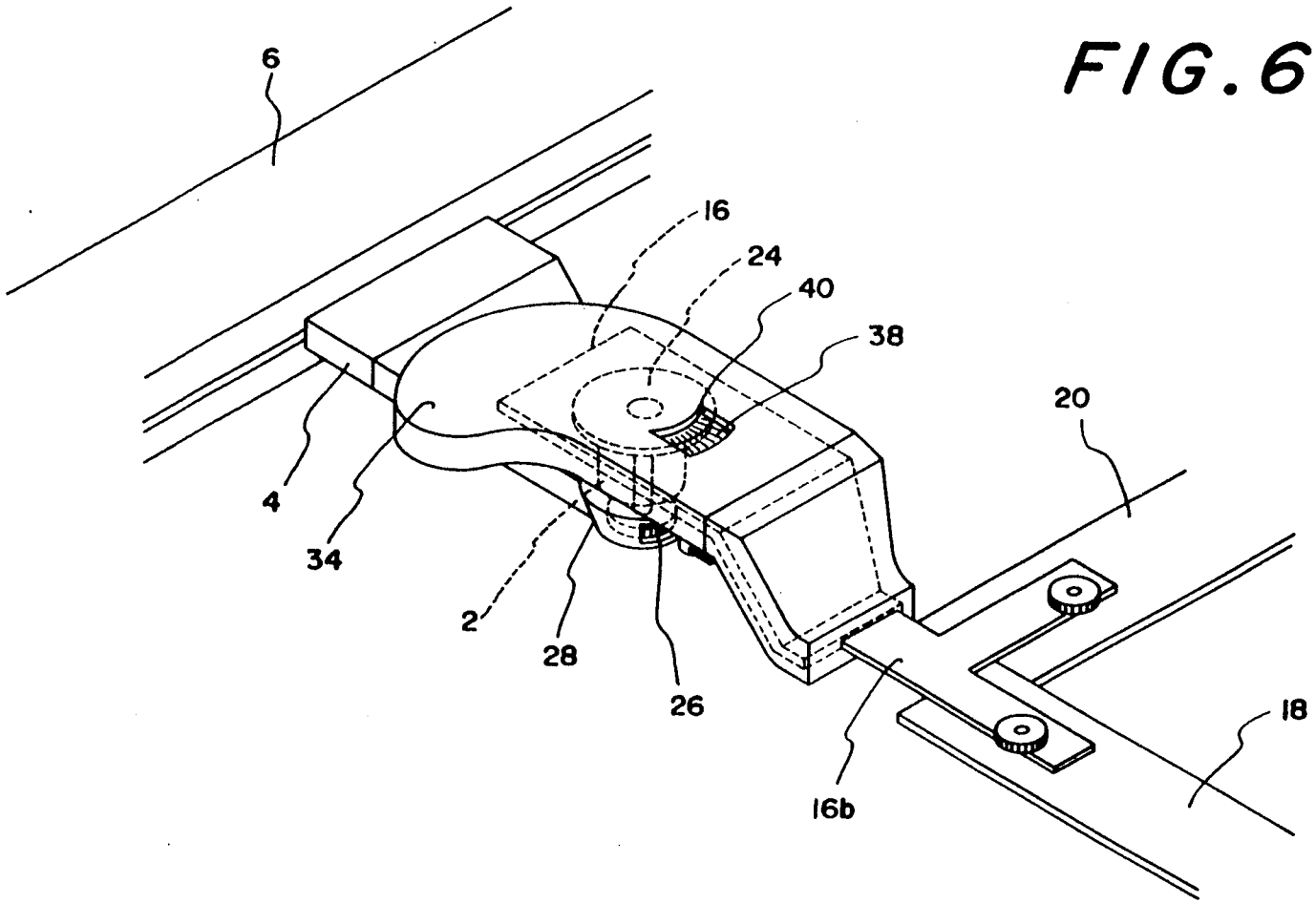
FIG. 6 is a perspective view of the head of universal parallel ruler showing another embodiment of the present invention.

The structure of the head according to the present invention will be described by referring to embodiments shown in the accompanied drawings. The base 2 of a head of universal parallel ruler is connected to a vertical cursor (not shown) mounted on a vertical or longitudinal rail 6 (see FIG. 6) so as to be movable through a double hinge mechanism 4. The base 2 is supported so as to be movable in a desired direction in parallel relative to the face of a drafting board 8 by means of a support mechanism such as the vertical rail 6 and a horizontal of transverse rail (not shown). The pipe portion of a support member 10 fits the pipe portion of the base 2 and the support member 10 is integrally fixed to the base 2. A known index ring 12 is fixed to the upper portion of the pipe portion of the support member 10. A tubular main shaft 14 is inserted into the pipe portion of the support member 10 so as to be movable. A hole formed in the upper horizontal portion 16*a* of a scale mounting plate 16 fits about the main shaft 14. The upper horizontal portion 16*a* is fixed to the flange portion of the main shaft 14. Straightedges 18 and 20 are detachably fixed to the lower horizontal portion 16*b* of the scale mounting plate 16. A connecting shaft 22 is inserted into the main shaft 14 so as to be movable. Fixed on the upper end of the connecting shaft 22 is a protractor 24 on which a protractor scale is formed on its outer circumferential portion. A base line mole 26 is fixed to the lower end of the connecting shaft 22. A bottom cover 28 is fixed to the base 2. Magnets 30 and 32 are attached thereto. The lower face of the base line mole 26 is in tight contact with the magnetically attracting faces of the magnets 30 and 32 due to magnetic force. A handle 34 is affixed to the scale mounting plate 16. An opening 36 is formed in the bottom cover 28. An operator can manually rotate the mole 26 against the magnetic force of the magnets 30 and 32 through this opening 36. Fixed to the scale mounting plate 16 is an index member 38 consisting of a transparent plate on which an index line is drawn. The index line formed on the index member 38 is opposed to the protractor scale on the outer circumferential portion of the protractor disk 24. A display window 41 is formed on the handle 34 above the index member 38. An index claw 40 is supported on the scale mounting plate 16 by means of a shaft 42 so as to be rotatable. A pin 50, protruding on one end of a first index lever 48 an intermediate portion of which is supported by means of a shaft 46 on the scale mounting plate 16 so as to be rotatable, is slidingly fitted into a slot 44 formed in an intermediate portion of the index claw 40. A pin 58 protruding on the scale mounting plate 16 slidingly fits within an L-shaped groove 54 bored at one end of a second index lever 52. The other end of the first index lever 48 is supported by means of a shaft 56 on the other end of the second index lever 52 so as to be rotatable. The first index lever 48 is energized clockwise about the shaft 46 by the resilient force of a resilient spring 60 as shown in FIG. 2. A brake disk 62 is fixed to the lower face of the index ring 12 and a brake shoe 64 protruding on the scale mounting plate 16 is opposed to the upper face on the outer circumferential portion of the brake disk 62. The lower face on the outer circumferential face of the brake disk 62 is opposed to one end portion of a brake member 66 pivotally connected to the scale mounting plate 16. The one end portion of the brake member 66 is adapted to be driven so as to moved toward or separated from the scale mounting plate 16 by the rotation of a brake lever 69. The above-described brake member 66, brake lever 69, brake shoe 64 and brake disk 62 constitute a brake mechanism for fixing the scale mounting plate 16 to the index ring 12 so as to be detachable therefrom.

A plate 68 is fixed to the main shaft 14 through a double nut. A cylindrical member 70 is fixed thereto and a belt pulley 72 is fixed to the member 70. A belt pulley 74 is supported on the base 2 by means of a shaft 76 so as to be rotatable. An endless timing belt 79 is trained about the belt pulley 74 and the belt pulley 72. The pulley 74 is connected to a coil spring 80 through a wire rope 78. The tension of the coil spring 80 causes torque to be exerted counterclockwise about the shaft 76 in FIG. 2. This torque causes a thumb 83 to be rotated relative to a screw 82 so that a member 84 for connecting the wire rope 78 to the pulley 74 is moved in the radial direction of the pulley 74 so as to be adjustable. The pulleys 72 and 74 and the coil spring 80 constitute a scale balancer. When the drafting board stands vertically, a clockwise angular moment is generated in the main shaft 14 due to the weight of the scale mounting plate 16 and the straightedges 18 and 20 or the like in FIG. 2. This angular moment is adapted to cancel the counterclockwise angular moment exerted on the pulley 72 by means of the coil spring 80.

The operation of the heads, of embodiments according to the present invention will now be described.

Figure 5:
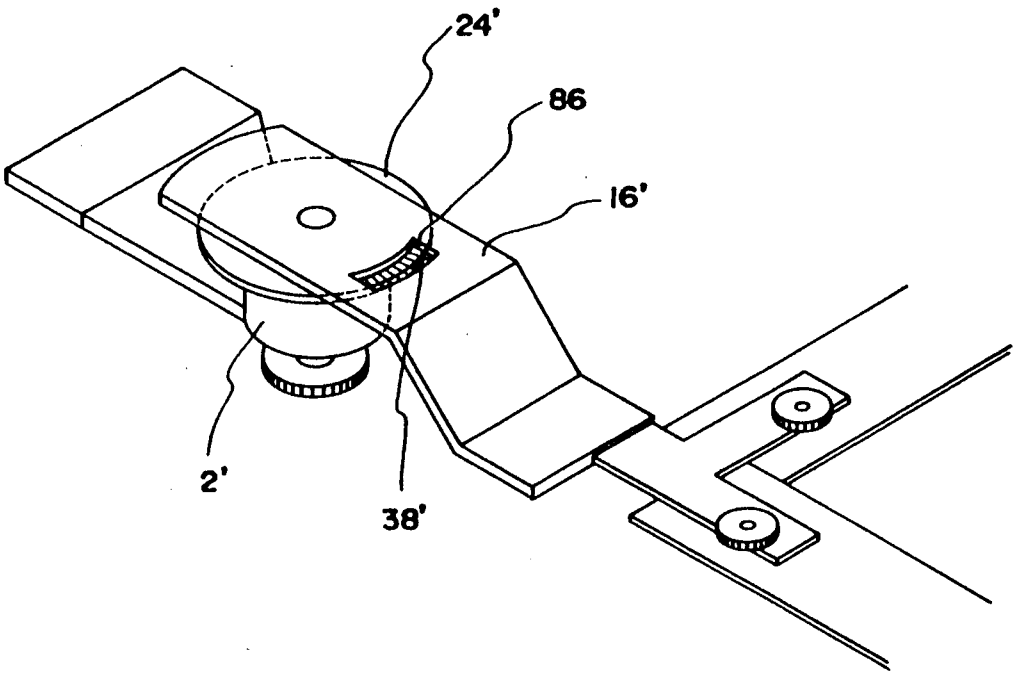
FIG. 5 is a perspective view of the head of universal parallel ruler of the present invention.

When the handle 34 is held by hand and pressed toward a parallel direction relative to the face of the drafting board 8, the base 2 moves in parallel along the face of the drafting board 8 so that the straightedges 18 and 20 can be moved in parallel to desired positions on the drafting board 8. The angle of the straightedges 18 and 20 can be read by viewing the position of the index line of the index member 38 opposed to the scale on the protractor 24. When it is necessary to set the angle of the straightedges 18 and 20 to a desired angle, the lever 69 is actuated to release the pressure of the brake member 66 against the brake disk 62 and the second index lever 52 is pushed downward in Fig 2 so as to release the engagement of the index claw 40 from the engaging recess 12*a* of the index ring 12. When the second index lever 52 is pushed, the first index lever 48 rotates counterclockwise about the shaft 46 and the index claw 40 rotates clockwise about the shaft 42 due to the pin 50, thereby the claw portion of the index claw 40 being disengaged from the engaging recess 12*a*. Under this state, the scale mounting plate 16 is freely rotatable relative to the base 2. An operator can, therefore, set the straightedges 18 and 20 to a desired angle by rotating the handle 34. When the handle 34 rotates, the main shaft 14 rotates and the connecting shaft 22 is apt to be rotated due to friction with the main shaft 14. The rotation of the connecting shaft 22 is, however, prevented by the attracting force of the magnets 30 and 32 to the mole 26 and therefore, the protractor 24 remains stationary relative to the scale mounting plate 16. Although, in the above embodiment, the scale mounting plate 16 is provided above the base 2 and the protractor 24 is provided above the scale mounting plate 16, another protractor 24' may be provided on the upper portion of a base 2' and a scale mounting plate 16' may be provided on the protractor 24' as shown in FIG. 5. In this case, it is necessary to provide an opening 86 for displaying the protractor scale on the scale mounting plate 16' and an index member 38' in this opening. The handle 34 may be integrally formed on the upper portion of the mounting plate 16.

As mentioned above, since the handle is provided on the scale mounting plate in the present invention, the operator is provided with the sensation of directly holding and manipulating the straightedge, and therefore, a plotting operation can be easily and effectively carried out.

What is claimed is:

1. A head of a universal parallel ruler for use on a drafting board, comprising:

a base adapted to be supported on and moved in parallel along the drafting board;

a scale mounting plate having an upper horizontal portion rotatably mounted on an upper portion of said base, and a lower horizontal portion disposed downwardly of said upper horizontal portion, said upper horizontal portion and said lower horizontal portion being disposed at opposing ends of said scale mounting plate;

a pair of straightedge members secured to said lower horizontal portion of said scale mounting plate and being adapted for movement along and in parallel with the drafting board; and a handle member mounted to said upper horizontal portion of said scale mounting plate and being adapted to be gripped by an operator and manipulated in order to rotate said scale mounting plate relative to said base.

2. A head of a universal parallel ruler as recited in claim 1, further comprising a protractor mounted to said base; and an index member fixed to said upper horizontal portion of said scale mounting plate in opposing relation to said protractor.

3. A head of a universal parallel ruler as recited in claim 2, wherein said base includes a pipe portion; and a connecting shaft is rotatably mounted in said pipe portion of said base, said protractor being fixed to an upper end of said connecting shaft.

4. A head of a universal parallel ruler as recited in claim 3, wherein said connecting shaft is coupled for rotation with said base.

5. A head of a universal parallel ruler as recited in claim 3, further comprising magnetic means for magnetically and adjustably fixing said connecting shaft to said base for rotation therewith.

6. A head of a universal parallel ruler as recited in claim 2, wherein a display window is provided in said handle member to allow the operator to view said protractor and said index member therethrough.

* * * * *